US005757146A

United States Patent [19]

Carder

[11] Patent Number: 5,757,146

[45] Date of Patent: May 26, 1998

[54] HIGH-GRADIENT COMPACT LINEAR ACCELERATOR

[76] Inventor: Bruce M. Carder, 205 Rogue River Hwy., Gold Hill, Oreg. 97525

[21] Appl. No.: 834,977

[22] Filed: Apr. 7, 1997

Related U.S. Application Data

[63] Continuation of Ser. No. 561,203, Nov. 9, 1995, abandoned.

[51] Int. Cl.[6] ..... H05H 9/00

[52] U.S. Cl. ..... 315/505; 315/541

[58] Field of Search ..... 315/500, 505, 315/507, 5.41, 5.42; 250/396 R; 313/359.1, 361.1; 361/311, 312, 313, 301.1, 306.2, 306.3, 306

[56] References Cited

U.S. PATENT DOCUMENTS 2,465,840 3/1949 Blumlein ..... 333/20

*Primary Examiner*—Sandra L. O'Shea
*Assistant Examiner*—Jay M. Patidar
*Attorney, Agent, or Firm*—Richard Main; William Daubenspeck; William R. Moser

[57] ABSTRACT

A high-gradient linear accelerator comprises a solid-state stack in a vacuum of five sets of disc-shaped Blumlein modules each having a center hole through which particles are sequentially accelerated. Each Blumlein module is a sandwich of two outer conductive plates that bracket an inner conductive plate positioned between two dielectric plates with different thicknesses and dielectric constants. A third dielectric core in the shape of a hollow cylinder forms a casing down the series of center holes, and it has a dielectric constant different that the two dielectric plates that sandwich the inner conductive plate. In operation, all the inner conductive plates are charged to the same DC potential relative to the outer conductive plates. Next, all the inner conductive plates are simultaneously shorted to the outer conductive plates at the outer diameters. The signal short will propagate to the inner diameters at two different rates in each Blumlein module. A faster wave propagates quicker to the third dielectric core across the dielectric plates with the closer spacing and lower dielectric constant. When the faster wave reaches the inner extents of the outer and inner conductive plates, it reflects back outward and reverses the field in that segment of the dielectric core. All the field segments in the dielectric core are then in unipolar agreement until the slower wave finally propagates to the third dielectric core across the dielectric plates with the wider spacing and higher dielectric constant. During such unipolar agreement, particles in the core are accelerated with gradients that exceed twenty megavolts per meter.

9 Claims, 7 Drawing Sheets

40
28
12
-
+
10
10
10
10
10
16
14
18
20
22

40
e-
28
12
-
+
10
16
14
18
20
22

HIGH-GRADIENT COMPACT LINEAR ACCELERATOR

This application is a continuation of application Ser. No. 08/561,203 filed Nov. 9, 1995, now abandoned.

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to linear accelerators and more particularly to dielectric wall accelerators and pulse-forming lines that operate at high gradients, e.g., in excess of twenty megavolts per meter, to feed an accelerating pulse down an insulating wall.

2. Description of Related Art

Particle accelerators are used to increase the energy of electrically-charged atomic particles, e.g., electrons, protons, or charged atomic nuclei, so that they can be studied by nuclear and particle physicists. High energy electrically-charged atomic particles are accelerated to collide with target atoms, and the resulting products are observed with a detector. At very high energies the charged particles can break up the nuclei of the target atoms and interact with other particles. Transformations are produced that tip off the nature and behavior of fundamental units of matter. Particle accelerators are also important tools in the effort to develop nuclear fusion devices.

The energy of a charged particle is measured in electron volts, where one electron volt is the energy gained by an electron when it passes between electrodes having a potential difference of one volt. A charged particle can be accelerated by an electric field toward a charge opposite that of the charged particle. Beams of particles can be magnetically focused, and superconducting magnets can be used to advantage. Early machines in nuclear physics used static, or direct, electric fields. Most modern machines, particularly those for the highest particle energies, use alternating fields, where particles are exposed to the field only when the field is in the accelerating direction. When the field is reversed in the decelerating direction, the particles are shielded from the field by various electrode configurations.

The simplest radio frequency accelerator is the linear accelerator, or linac, and comes in different forms, depending electrons or ions are to be accelerated. For accelerating ions, frequencies of under 200 MHz are used. The ions are injected along the axis of a long tank excited by high-power radio frequency in an electric field along the axis. The ions are shielded from the decelerating phases by drift tubes in the tank through which the beam passes. As the particles gain energy and velocity, they travel farther during the deceleration phase. Therefore, the drift tubes must be longer toward the end of the tank to match the period of the accelerating field.

The first linear accelerator had three drift tubes and was built in 1928 by Rolf Wideroe of Norway. Sodium and potassium ions were accelerated to demonstrate the principle of radio frequency acceleration. During the 1930's, the University of California did further work on ion-type linear accelerators. But application of the principle was delayed until after World War II because of a lack of high-power radio frequency amplifiers. The development of radar provided such amplifiers. Shortly after the war, Luis Walter Alvarez built the first proton linear accelerator in which protons reached an energy of 32 million electron volts (MeV). Two megawatts were required at a frequency of about 200 MHz and limited the machine to one millisecond pulses.

Since 1950, several proton and ion linear accelerators have been built, some as injectors for still larger machines and some for use in nuclear physics. A large modern accelerator is the 800-MeV machine at the Los Alamos Scientific Laboratory, New Mexico, and is used as a meson factory in the study of intermediate-mass particles, e.g., those with masses heavier than the electron and lighter than the proton. These intermediate-mass particles seem to provide the force that binds atomic nucleus.

Because electrons are much lighter than ions, their velocity at a given energy is significantly higher than that of ions. The velocity of a one-MeV proton is less than five percent that of light. In contrast, a one-MeV electron has reached ninety-four percent of the velocity of light. This makes it possible to operate electron linacs at much higher frequencies, e.g., about 3,000 MHz. The accelerating system for electrons can be a few centimeters in diameter. The accelerating systems for ions need diameters of a few meters. Electron linacs having energies of ten to fifty MeV are widely used as X ray sources for treating tumors with intense radiation.

A very large electron linac, which began operation in 1966 at the Stanford Linear Accelerator Center (California), is more than 3.2 km (2 mi.) long and has been able to provide electrons with energies of fifty billion electron volts (50 GeV). The Stanford Linear Collider can provide relative collisions that produce energies of more than 100 GeV between a beam of electrons and a beam of positrons that are aimed to collide head-on.

FIG. 1 shows a cross-section of an induction cell in which an accelerating voltage appears only across an internal accelerating gap. The cell housing and the outside of the accelerator are at ground potential. A large number of induction cells can be stacked in series to produce high energy beams without needing proportionately high voltages outside the accelerator that can be dangerous and troublesome to maintain. The core is a solid cylinder of either ferro-magnetic or ferri-magnetic with a coaxial central hole for the beam current. The core imparts a very large inductance to a conducting path that begins on the entire outside circumference of the core at the coaxial feed and wraps around one end to the inside circumference to the opposite end and the housing ground. A high voltage pulse from the coaxial creates a field along a vacuum accelerating gap that drives a particle beam through the axis of the core. The vacuum accelerating gap appears to be in parallel with a large inductance. In a typical induction cell, the cell is generally azimuthally symmetric except for a number of coaxial feed lines that supply the accelerating voltage from a pulsed-power unit. The inductive isolation of the voltage persists in time until the core saturates, the inductance reduces to a very low value, and the voltage is shunted to ground. In practice, accelerator cores are driven towards negative saturation after the accelerating pulse to increase the available flux swing. After the application of a reset pulse, the field inside the core will relax to $B_r$, the remnant field. As the core is subjected to an accelerating pulse, the magnetic domains of the core all align and the permeability of the material falls. The core is then said to be saturated and the field level is $B_s$.

Conventional pulsed power systems for induction cells include devices constructed of nested pairs of coaxial transmission lines, so-called Blumlein devices, e.g., as shown in FIG. 2. See, U.S. Pat. No. 2,465,840, issued 1948 to A. D. Blumlein, and incorporated here by reference. A step-up transformer or Marx bank slow charging system is connected between an intermediate conductor of the Blumlein and a grounded outer conductor. The output is taken between an inner conductor and the outer conductor which then provides a coaxial drive signal to the induction cell. When the Blumlein is fully charged, there is no net output voltage. But when a switch is closed to ground, a voltage wave is caused to propagate, left to right in FIG. 2, between the inner and outer conductor of the line to the output. This voltage feeds the induction cell with a relatively fast pulse, e.g., on the order of tens of nanoseconds. The switch most often used includes high voltage electrodes separated by an insulating gas, e.g., a spark gap. Conventionally, a third trigger electrode is placed between the main two spark gap electrodes and is voltage pulsed to initiate a breakdown. Alternatively, a laser is used to ionize the insulating gas. The breakdown of the gas allows current to flow with a very low resistance. But such systems are repetition-rate limited by the recovery time of the spark gap switch. Higher repetition rates can be realized by blowing the insulating gas through the spark gap switch. Even so, such types of switches are limited to repetition rates that do not exceed several kilohertz.

A 50-MeV advanced test accelerator at Lawrence Livermore National Laboratory was constructed with a pulsed power system that used water-filled Blumleins of beam current for 70 nanoseconds at one Hz for extended periods. It could also provide short power bursts at one KHz by using gas blowers for the spark gaps.

In the early 1980's, free electron lasers were developed which required high average beam power in certain applications, e.g., microwave heating of tokamaks. A magnetic pulse compression power system capable of providing multi-kilohertz operation was developed. Instead of spark gaps, such magnetic pulse compressor systems used saturable magnetic switches, as illustrated in FIG. 3 with a simplified schematic. A capacitance $C_1$ is slowly charged to approximately twenty-five kilovolts by an external source. When the volt-seconds capacity of the magnetic saturable switch MI has been reached, its impedance rapidly collapses and the charge on the capacitor is dumped to ground through the primary of a step-up transformer to produce a still higher voltage across a capacitor $C_2$. When the volt-seconds capacity of a second magnetic saturable switch $M_2$ has been reached, capacitor $C_2$ discharges into a water-filled transmission or pulse-forming line. A third magnetic saturable switch $M_3$ then couples the output of the pulse-forming line into a bank of induction cells in parallel. The transfer of energy from one capacitor to the next occurs more rapidly in each succeeding stage if the product of the saturated switch inductance and the storage capacitance drops from one stage to the next. A similar system was used to power the ETA-II accelerator at Lawrence Livermore National Laboratory and is now in fairly wide use. The ETA-II machine produces as many as fifty pulse bursts at rates exceeding three KHz. Each so-called MAG 1-D pulse compressor has been able to drive as many as twenty accelerator cells at approximately 112 kilovolts with a beam current in excess of two kiloamperes.

But such low repetition rates were sorely inadequate by the 1990's. One promising approach to inertial confinement fusion was the use of heavy ion beams to drive the targets. In typical designs, ten GeV uranium ions are needed at tens of kiloamperes for an efficient power plant. Two configurations suitable for heavy ion fusion use induction accelerator technology, e.g., linear induction accelerators and recirculators. Useful recirculators require repetition rates far in excess of those that can be achieved by magnetic pulse compression. The standard approach to providing such beams has been to use induction linacs operated at about ten Hz. But with conventional technology, linear induction accelerator would need to be about ten kilometers long. Recirculating a beam through small number of induction cells can substantially reduce the cost, but the induction cells would have to be able to operate at pulse repetition rates as high as 100 KHz.

The operational demands imposed on a pulsed power system to properly operate a recirculating induction linac are severe. The accelerating pulse shape and duration are preferably modified as the ions accelerate and the beam is longitudinally compressed. A typical induction linac is capable of producing beams in the kiloampere range with an average accelerating gradient as great as one megavolt/meter. But particle acceleration actually only occurs in the accelerating gaps, and these generally constitute only a small fraction of the total machine. What is needed is an axial accelerating field that continues over the entire structure and thus can achieve a much higher gradient, e.g., fifteen megavolt/meter or more.

SUMMARY OF THE INVENTION

An object of the present invention is to provide a compact linear accelerator.

A further object of the present invention is to provide a linac capable of very high repetition rates.

Another object of the present invention is to provide a linac that provides particle acceleration along the whole length of its stalk.

Briefly, a high-gradient linear accelerator embodiment of the present invention comprises a solid-state stack in a vacuum of five sets of disc-shaped Blumlein modules each having a center hole through which particles are accelerated one module to the next. Each Blumlein module is a sandwich of two outer conductive plates that bracket an inner conductive plate positioned between two dielectric plates with different thicknesses and dielectric constants. A third dielectric core in the shape of a hollow cylinder forms a casing down the series of center holes, and it has a dielectric constant different than the two dielectric plates that sandwich the inner conductive plate. In operation, all the inner conductive plates are charged to the same DC potential relative to the outer conductive plates. Next, all the inner conductive plates are simultaneously shorted to the outer conductive plates at the outer diameters. The signal short will propagate to the inner diameters at two different rates in each half of the Blumlein module. A faster wave propagates quicker to the third dielectric core across the dielectric plates with the closer spacing and lower dielectric constant. When the faster wave reaches the inner extents of the outer and inner conductive plates, it reflects back outward and reverses the field in that segment of the dielectric core. All the field segments in the dielectric core are then in unipolar agreement until the slower wave finally propagates to the third dielectric core across the dielectric plates with the wider spacing and higher dielectric constant. During such unipolar agreement, particles in the core are accelerated with gradients that exceed twenty megavolts per meter.

An advantage of the present invention is that a linac is provided that is compact.

Another advantage of the present invention is that a linac is provided that can be used in recirculating accelerators.

A further advantage of the present invention is that a linac is provided that supports very high voltage gradients.

DETAILED DESCRIPTION OF THE INVENTION

Figures 1, 2:
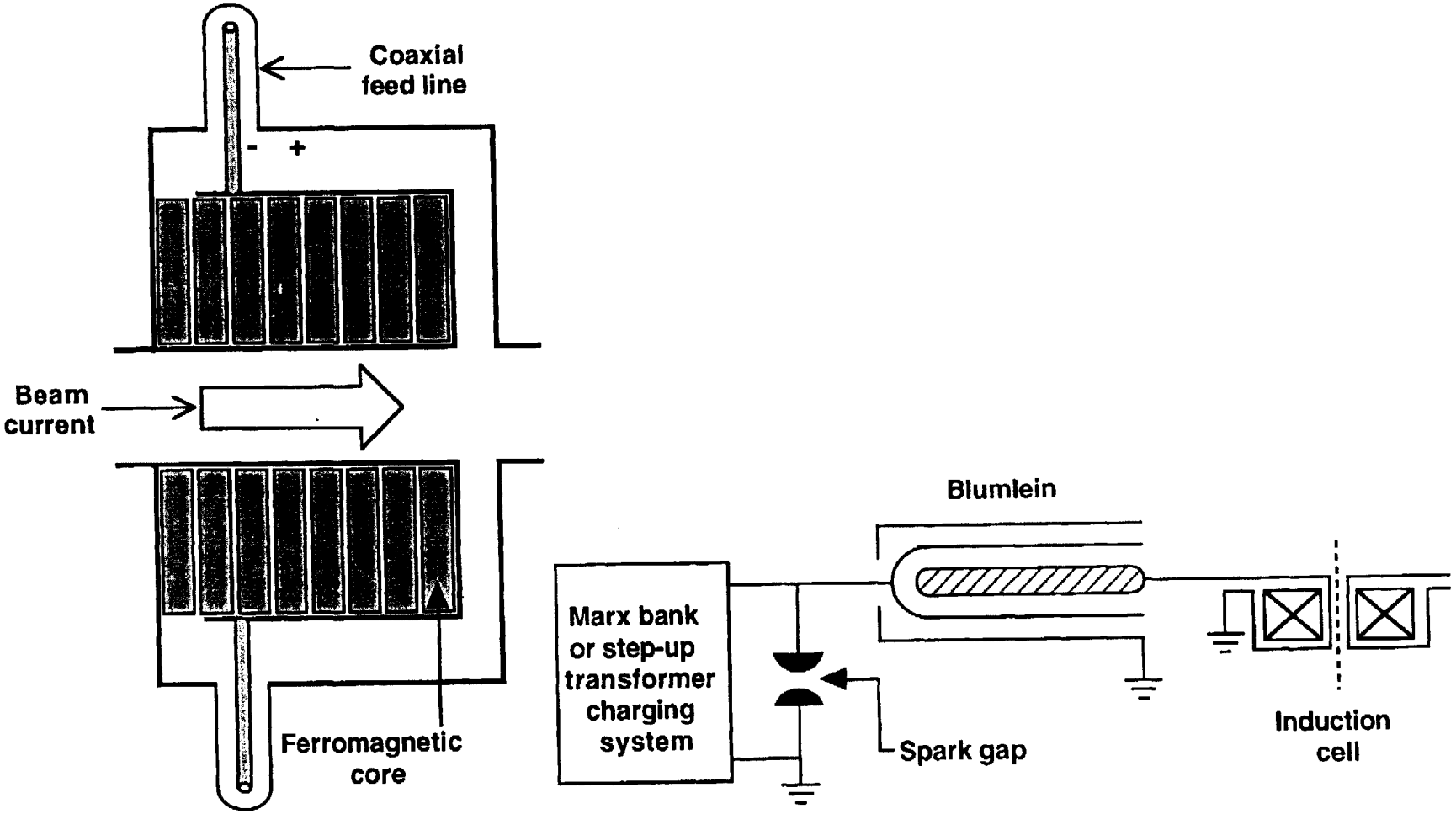
Fig. 1 (prior art)
Fig. 2 (prior art)
FIG. 1 shows a cross-section of a prior art induction cell in which an accelerating voltage appears only across an internal accelerating gap.
FIG. 2 is a diagram of a prior art Blumlein-type of pulse power system for an induction cell like that of FIG. 1.
Figure 3:
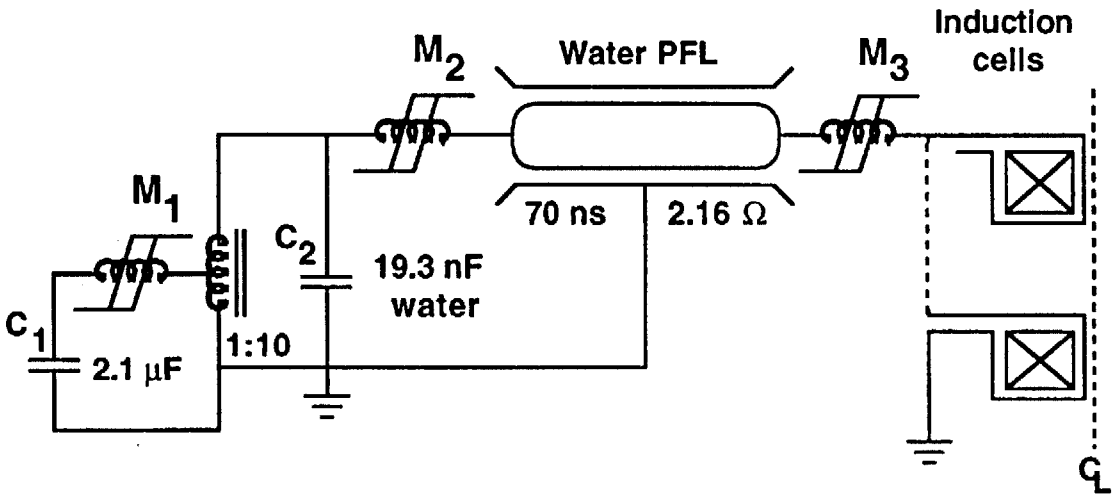
Fig. 3 (prior art)
FIG. 3 is a diagram of a prior art water-filled pulse-forming-line-type of pulse power system with magnetic saturation switches.
Figure 4A:
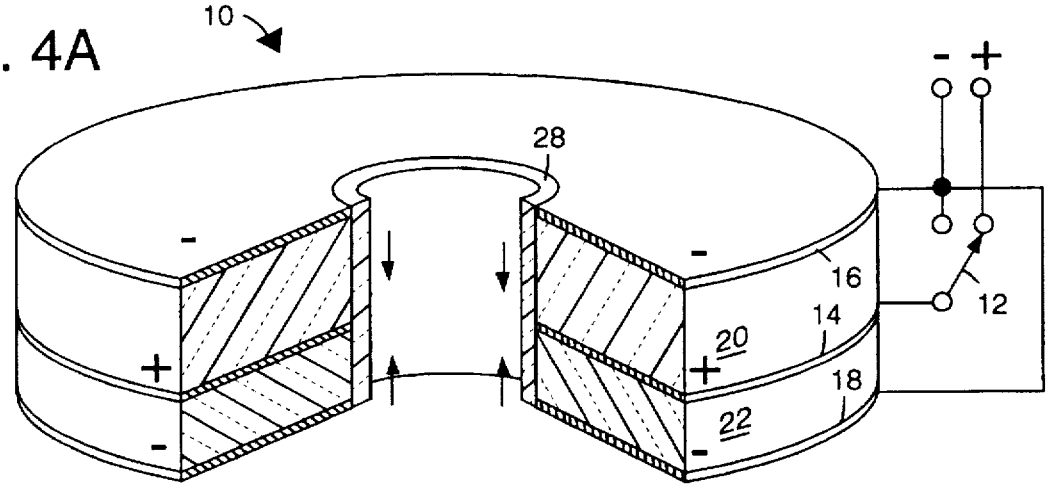
FIGS. 4A–4C are a time-series of cutaway-perspective diagrams of a compact solid-state linac embodiment of the present invention related to the closure of a switch.
Figure 4B:
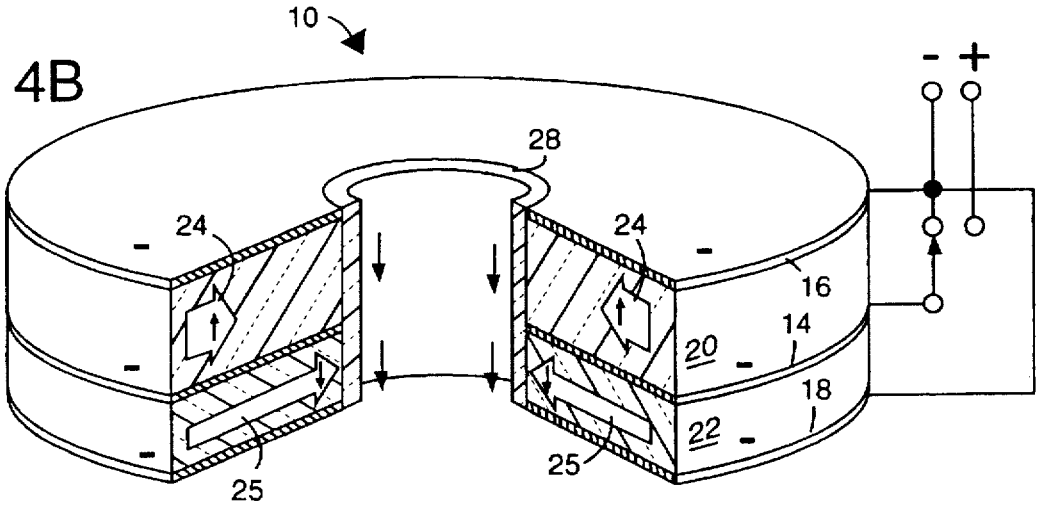
Figure 4C:
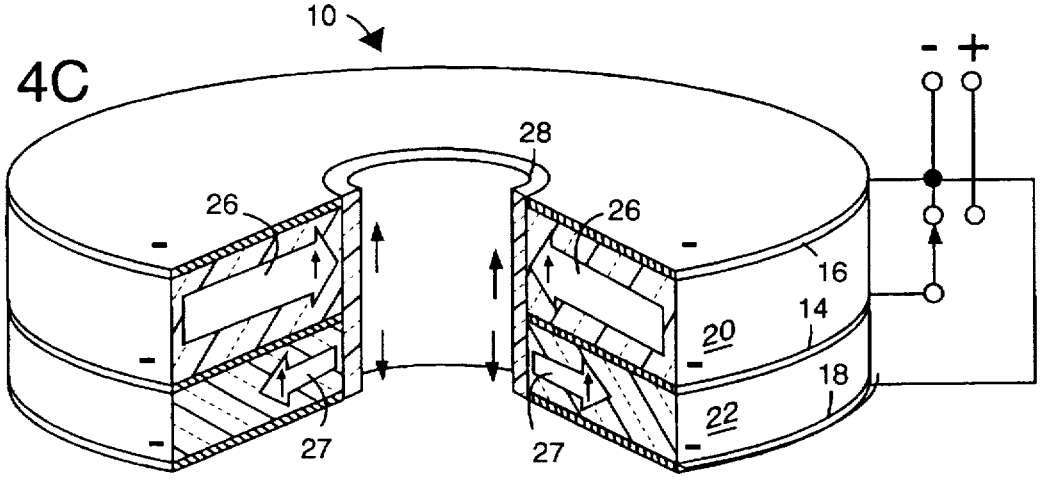

FIGS. 4A–4C illustrate a Blumlein linear accelerator (linac) module of the present invention, referred to herein by the general reference numeral 10. FIGS. 4A–4C represent a time-series that is related to the state of a switch 12. In a first condition at t0, the switch 12 is connected to be able to short circuit a middle conductive plate 14 a pair of top and bottom conductive plates 16 and 18. The switch 12 is connected to allow the middle conductive plate 14 to be charged by a high voltage source. A dielectric 20 with a relatively high dielectric constant, $\epsilon_1$, separates the conductive plates 14 and 16, for example titanium dioxide may be used. A dielectric 22 with a relatively low dielectric constant, $\epsilon_2$, separates the conductive plates 14 and 18, for example ordinary printed circuit board substrates may be used like RT Duroid epoxy. Preferably, the dielectric constant $\epsilon_1$ is nine times greater than the dielectric constant $\epsilon_2$. The middle conductive plate 14 is set closer to the bottom conductive plate 18 than it is to the top conductive plate 16, such that the combination of the different spacing and the different dielectric constants results in the same characteristic impedance on both sides of the middle conductive plate 14. Although the characteristic impedance may be the same on both halves, the propagation velocity of signals through each half is not at all the same. The higher dielectric constant half with dielectric 20 is much slower. This difference in relative propagation velocities is represented by a short fat arrow 24 and a long thin arrow 25 in FIG. 4B, and by a long fat arrow 26 and a reflected short thin arrow 27 in FIG. 4C.

Figure 6:
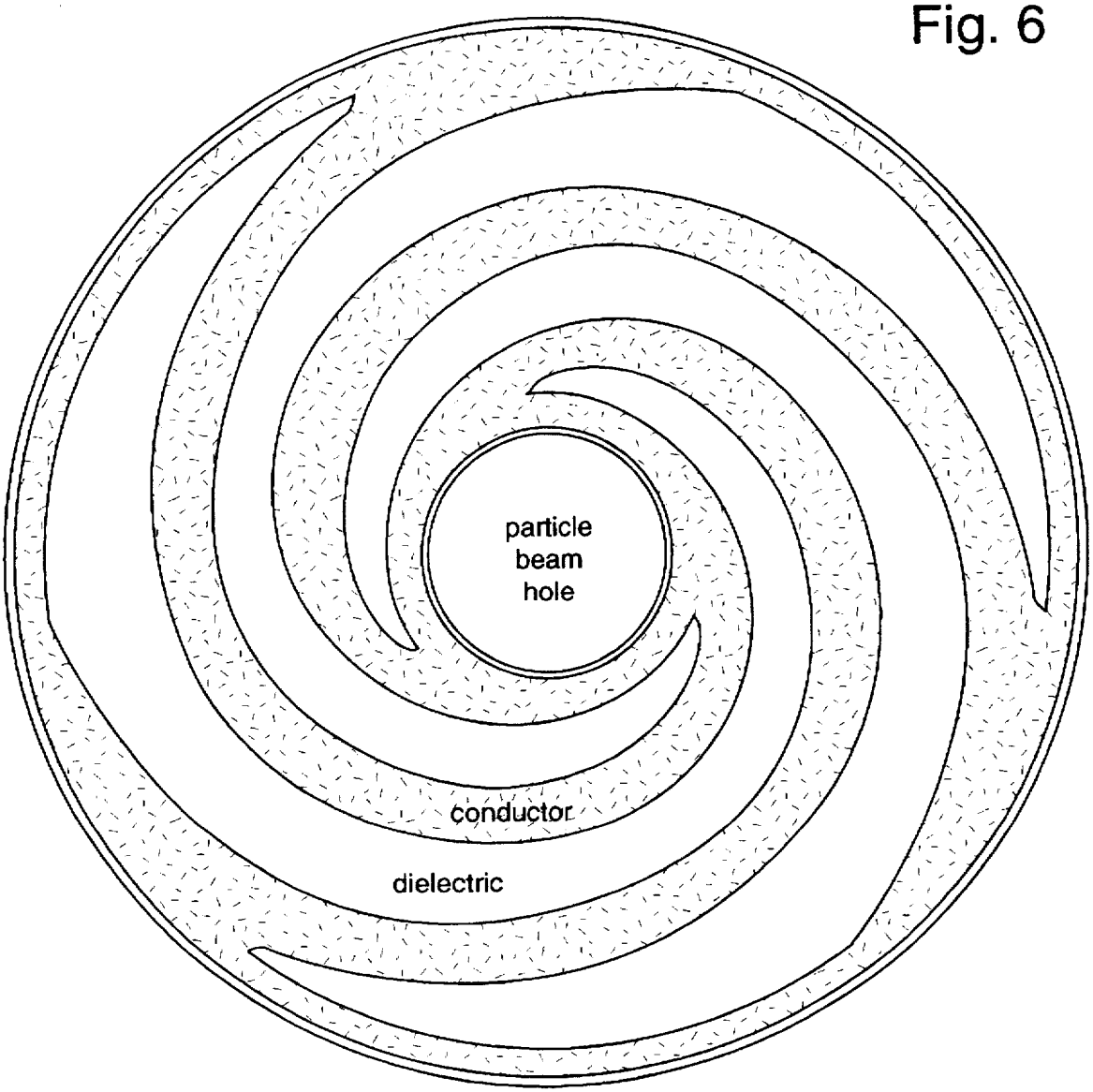
FIG. 6 is a diagram of a spiral conductor plate.

The linac 10 can be thought of as consisting of two radial transmission lines which are filled with different dielectrics. The line having the lower value of dielectric constant is called the "fast" line and the one having the higher dielectric constant is termed the "slow" line. Initially, both lines are oppositely charged so that there is no net voltage along the inner length of the assembly. After the lines have been fully charged, the switch 12 closes across the outside of both lines at the outer diameter of the linac 10. This causes an inward propagation of the voltage waves 24 and 25 which carry opposite polarity to the original charge such that a zero net voltage will be left behind in the wake of each wave. When the fast wave 25 hits the inner diameter of its line, it reflects back from the open circuit it encounters. Such reflection doubles the voltage amplitude of the wave 25 and causes the polarity of the fast line to reverse. This is because twice the original charge voltage is subtracted from the original charge voltage in the wave 25 at the reflection. For only an instant moment more, the voltage on the slow line at the inner diameter will still be at the original charge level and polarity. After the wave 25 arrives but before the wave 24 arrives at the inner diameter, the field voltages on the inner ends of both lines are oriented in the same direction and add to one another, as shown in FIG. 4B. Such adding of fields produces an impulse field that can be used to accelerate a beam. Such impulse field is neutralized, however, when the slow wave 24 eventually arrives and reverses the polarity of the slow line, as is illustrated in FIG. 4C. The time that the impulse field exists can be extended by increasing the distance that the voltage waves 24 and 25 must traverse. One way is to simply increase the outside diameter of the linac 10. Another, more compact way is to replace the solid discs of the conductive plates 14, 16 and 18 with one or more spiral conductors that are connected between conductor rings at the inner and outer diameters, as is illustrated in FIG. 6. For example, the spiral conductors may be patterned in copper clad using standard printed circuit board techniques on both sides of a fiberglass-epoxy substrate that serves as the dielectric 22. Multiple ones of these may then be used to sandwich several dielectrics 20 to form a stack.

As shown in FIGS. 4A–4C, a sleeve 28 fabricated from a dielectric material is molded or otherwise formed on the inner diameter of the linac 10 to provide a dielectric wall. A particle beam is introduced at one end of the dielectric wall 28 that accelerates along the central axis. For example, a velvet cloth field emitter can be used at one closed and grounded end as a source of electrons. The dielectric sleeve 28 is preferably thick enough to smooth out at the central axis the alternating fields represented inside the walls by the vertical arrows in FIGS. 4A and 4C. Such dielectric sleeve 28 also helps prevent voltage flash-over between the inside edges of the conductive plates 14, 16 and 18, therefore the sleeve 28 should be tightly fitted or molded in place. The dielectric constant of the material of the sleeve 28 is preferably four times that of the dielectric 22. Thus the preferred ratio of dielectric constants amongst the dielectrics 22 and 20 and the sleeve 28 is 1:9:4.

Switch 12 is representative of a suitable switch that can operate at the high gradients that exist at the outside circumference of the linac 10. When operating at such high voltage gradients, the outer surface of the fast and slow lines of the linac 10 are consequently exposed to a high electric field stress and can easily threaten a self-initiated surface breakdown. Since it is known that flash-overs and breakdowns avalanche to full conduction quickly, the surface breakdown mechanism promises to be an ideal closing switch if it is controlled properly. Such switch control may be practical by intensely illuminating the outside surface with a prompt flux of ultraviolet (UV) photons, e.g., as are available from a laser. Photon bombardment has been observed as a reliable trigger for surface breakdown switching. Other researchers working for the present Assignee, built a vacuum chamber that permitted high-gradient linac prototypes to be charged to high voltage with a Marx bank. A frequency doubled, tripled or quadrupled Nd-YAG laser (1.06 μm) was introduced through a port and lenses and brought to a line focus approximately one millimeter by one centimeter along the outside of the test device. The energy required to initiate the breakdown was measured as a function of the charge voltage across the sample and the wavelength of the incident light. It was found that a few milli-joules per switch point were sufficient for reliable surface breakdown function. Such laser-induced surface flash-over switches appear to work well at gradients up to 150 kilovolts/cm (15 megavolts/meter) and currents of two kiloamperes. Higher gradients than this seem to require special insulation and dielectric materials.

Figure 5A:
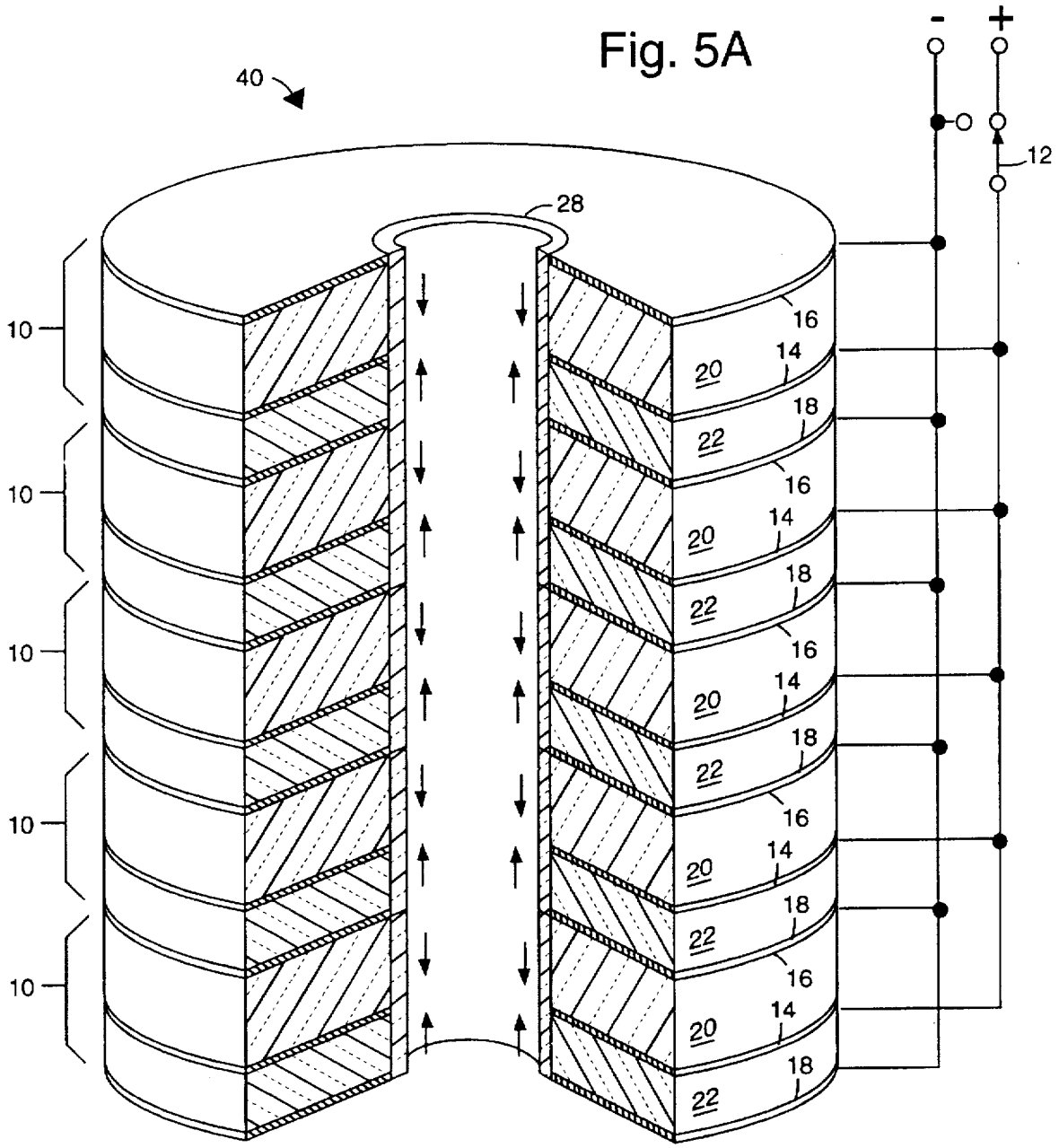
FIGS. 5A–5C are a time-series of cutaway-perspective diagrams of a five-layer stack of compact solid-state linac similar to that shown in FIGS. 4A–4C and showing the state of an accelerating field related to the closure of a switch.
Figure 5B:
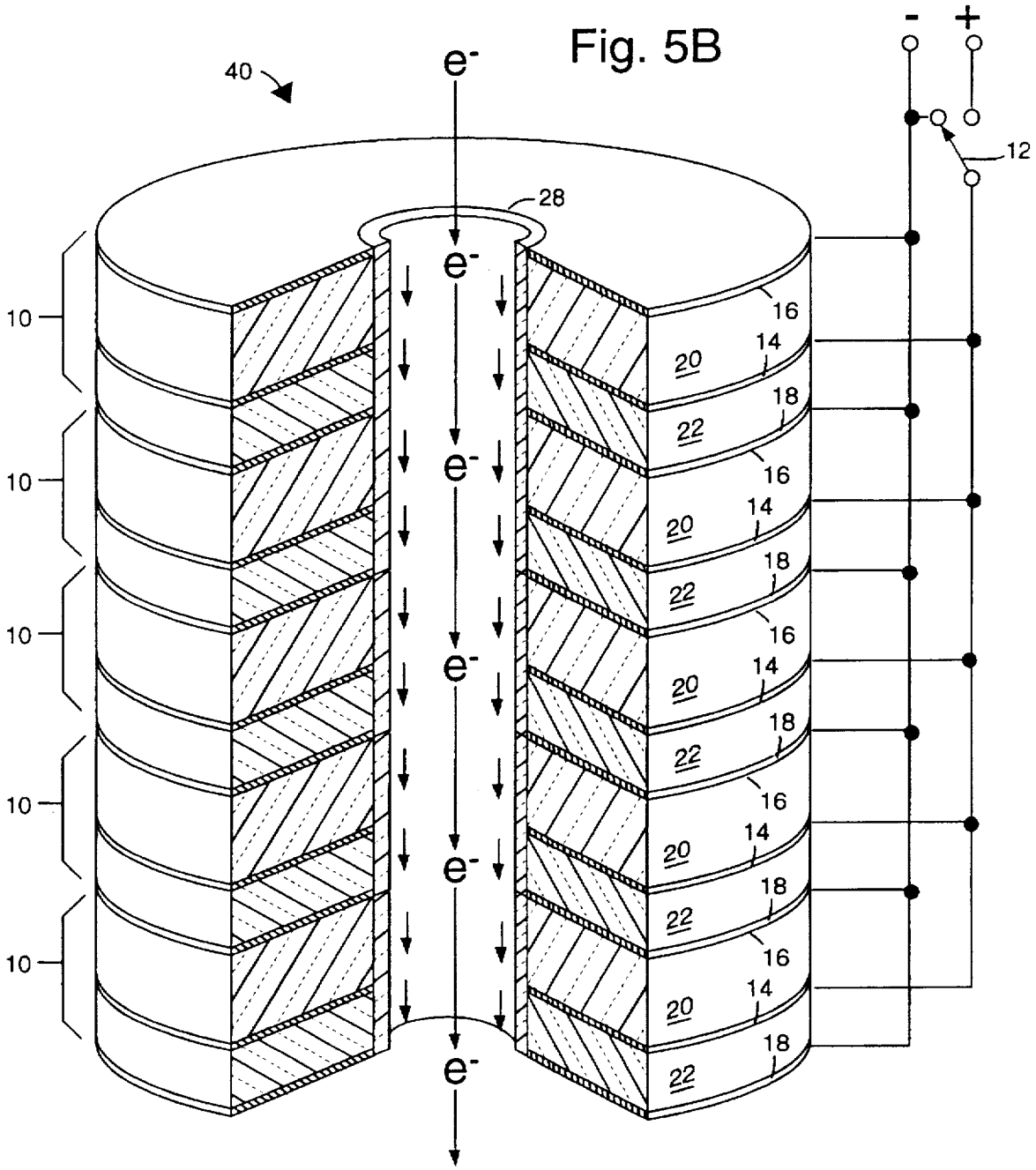
Figure 5C:
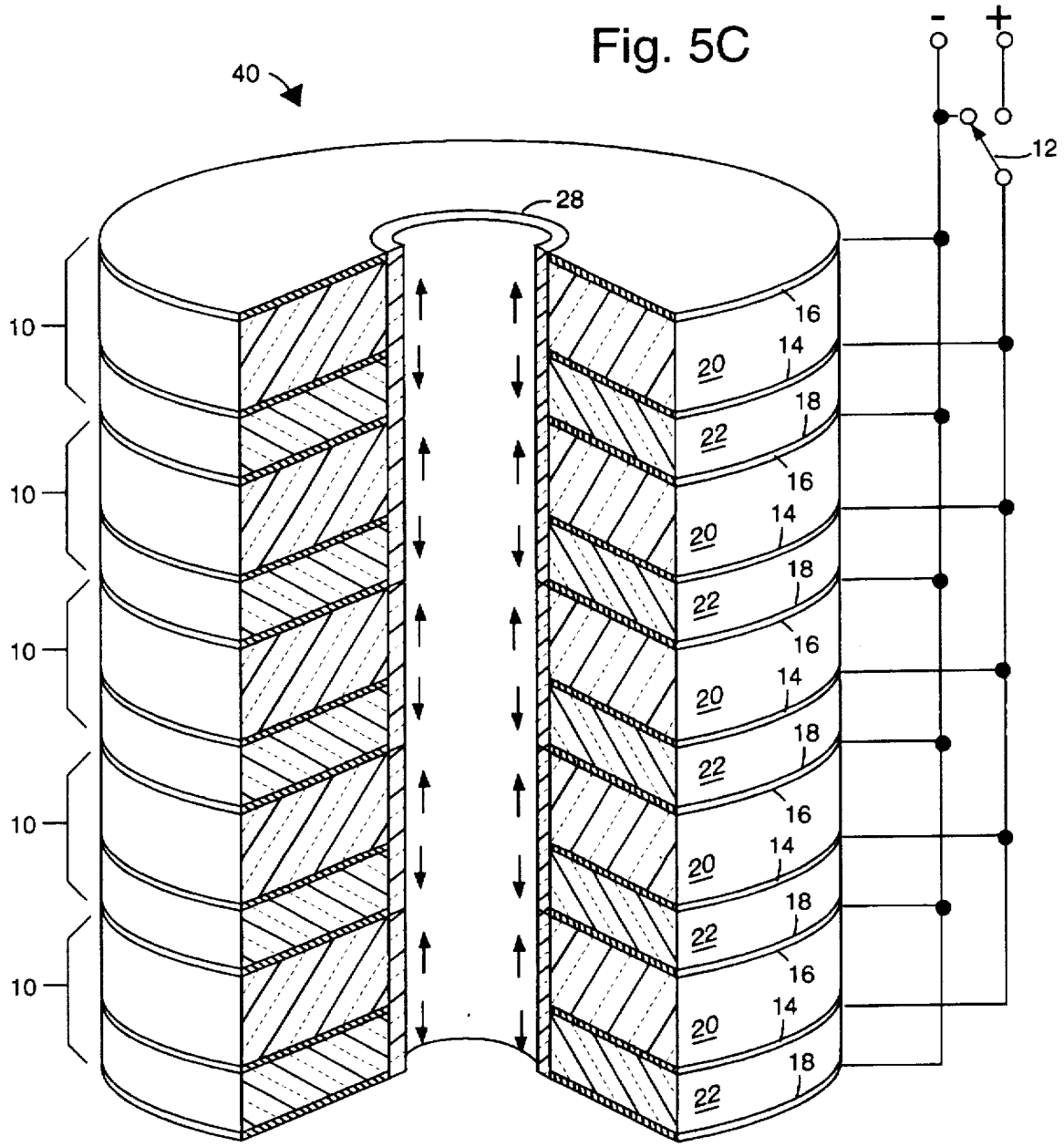

FIGS. 5A–5C illustrate a multi-stage linac system 40 for use in a vacuum chamber. A time series similar to that shown for FIGS. 4A–4C is represented. The net effect of five linacs 10 that all share a common stalk comprising dielectric sleeve 28 is shown in each of the drawings. A laser surface flash-over switch can be used in place of switch 12 in which laser light is directed to the outer surface via a bundle of fiber optic cables that provide several switch points per line for each of the five linacs 10. It may be possible to demonstrate gradients at least as high as five megavolts/meter with careful insulation and choice of dielectrics.

FIG. 6 illustrates a compact way to replace the solid discs of the conductive plates 14, 16 and 18 with one or more spiral conductors that are connected between conductor rings at the inner and outer diameters.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A linear accelerator (linac), comprising:

a first plane with a first flat planar conductor having a first central hole, and connected to a ground potential;

a second plane adjacent to and parallel with the first plane and having a second flat planar conductor with a second central hole that shares an axis with said first central hole, and switchable to both said ground potential and a high voltage potential;

a third plane adjacent to and parallel with the second plane and having a third flat planar conductor with a third central hole that shares said axis with said first and second central holes, and connected to a ground potential;

a first dielectric sheet that fills the space separating said first and second planar conductors and that comprises a first material with a first dielectric constant; and a second dielectric sheet that fills the space separating said second and third planar conductors and that comprises a second material with a second dielectric constant that is substantially greater than the dielectric constant of said first material;

wherein a substantial difference in electrical signal wavefront propagation velocity exists between the first and second dielectric sheets from the outside perimeters of the first through third flat planar conductors and their respective first through third central holes.

2. The linac of claim 1, further comprising:

high voltage power supply means connected to charge said second flat planar conductor to a high potential; and switch means connected between outside edges of said first through third flat planar conductors for repeated short circuiting of said high potential;

wherein, an accelerating field is momentarily created in one direction along said axis through said first through third central holes an instant after the switch means is closed for short circuiting said high potential.

3. The linac of claim 1, wherein:

said second material has a dielectric constant that is nine times the dielectric constant of said first material; and said second material has a thickness greater than the thickness of said first material and said second flat planar conductor is spaced between said first and third flat planar conductors to equalize the characteristic electrical impedance on either side of said second flat planar conductor with respective first and third flat planar conductors.

4. The linac of claim 1, further comprising:

a dielectric sleeve fitted through the inside diameters of said first through third central holes as a hollow tube open to pass a particle beam along said axis.

5. The linac of claim 4, wherein:

the dielectric sleeve comprises a third material with a dielectric constant that is four times that of said first material;

wherein the dielectric constants of said first through third materials have a ratio of 1:9:4.

6. The linac of claim 1, wherein:

said first through third flat planar conductors have circular outside perimeters and the whole linac combines to form a solid cylinder with a coaxial cylindrical hole.

7. The linac of claim 1, wherein:

said first through third flat planar conductors comprise inner and outer conductive rings between which are connected in parallel a plurality of spiral conductors;

wherein the electrical length between said inner and outer conductive rings is increased over their radial separations by said plurality of spiral conductors.

8. A linear accelerator (linac), comprising:

a first plane with a first flat planar conductor having a first central hole, and connected to a ground potential;

a second plane adjacent to and parallel with the first plane and having a second flat planar conductor with a second central hole that shares an axis with said first central hole, and switchable to both said ground potential and a high voltage potential;

a third plane adjacent to and parallel with the second plane and having a third flat planar conductor with a third central hole that shares said axis with said first and second central holes, and connected to a ground potential;

a first dielectric sheet that fills the space separating said first and second planar conductors and that comprises a first material with a first dielectric constant;

a second dielectric sheet that fills the space separating said second and third planar conductors and that comprises a second material with a second dielectric constant that is substantially greater than the dielectric constant of said first material, wherein a substantial difference in electrical signal wavefront propagation velocity exists between the first and second dielectric sheets from the outside perimeters of the first through third flat planar conductors and their respective first through third central holes;

high voltage power supply means connected to charge said second flat planar conductor to a high potential;

switch means connected between outside edges of said first through third flat planar conductors for repeated short circuiting of said high potential, wherein, an accelerating field is momentarily created in one direction along said axis through said first through third central holes an instant after the switch means is closed for short circuiting said high potential; and a dielectric sleeve fitted through the inside diameters of said first through third central holes as a hollow tube open to pass a particle beam along said axis;

wherein, said first through third flat planar conductors have circular outside perimeters and the whole linac combines to form a solid cylinder with a coaxial cylindrical hole, said first through third flat planar conductors comprise inner and outer conductive rings between which are connected in parallel a plurality of spiral conductors, wherein the electrical length between said inner and outer conductive rings is increased over their radial separations by said plurality of spiral conductors.

9. The linac of claim 8, wherein:

said second material has a dielectric constant that is nine times the dielectric constant of said first material;

said second material has a thickness greater than the thickness of said first material and said second flat planar conductor is spaced between said first and third flat planar conductors to equalize the characteristic electrical impedance on either side of said second flat planar conductor with respective first and third flat planar conductors; and the dielectric sleeve comprises a third material with a dielectric constant that is four times that of said first material;

wherein the dielectric constants of said first through third materials have a ratio of 1:9:4.

* * * * *